US005783379A

United States Patent [19]

Willems et al.

[11] Patent Number: 5,783,379

[45] Date of Patent: Jul. 21, 1998

[54] X-RAY SILVER HALIDE PHOTOGRAPHIC MATERIAL SUITABLE FOR MAINTENANCE IN BRIGHT DARKROOM LIGHTING CONDITIONS

[75] Inventors: Peter Willems, Stekene; Freddy Henderickx, Olen, both of Belgium

[73] Assignee: Agfa-Gevaert, N.V., Mortsel, Belgium

[21] Appl. No.: 680,404

[22] Filed: Jul. 15, 1996

[30] Foreign Application Priority Data

Jul. 18, 1995 [EP] European Pat. Off. ..... 95201975

[51] Int. Cl.[6] ..... G03C 1/815; G03C 5/16

[52] U.S. Cl. ..... 430/603; 430/401; 430/507; 430/567; 430/605; 430/621; 430/963; 430/966

[58] Field of Search ..... 430/603, 605, 430/966, 507, 569, 567, 963, 401, 621, 438, 440

[56] References Cited

U.S. PATENT DOCUMENTS 3,658,547 4/1972 Shiba et al. .
5,380,634 1/1995 Kiekens et al. ..... 430/507
5,397,687 3/1995 Willems et al. ..... 430/502
5,434,033 7/1995 Kawai ..... 430/357
5,447,826 9/1995 Heremans et al. ..... 430/405

*Primary Examiner*—Thorl Chea
*Attorney, Agent, or Firm*—Breiner & Breiner

[57] ABSTRACT

A silver halide photographic material for industrial radiography is disclosed comprising a film support and on one or both sides thereof at least one gelatino silver halide emulsion layer wherein each silver halide emulsion layer comprises as silver halide crystals silver chloride and/or silver chlorobromide crystals the amount of bromide therein being at most 25 mole %; has a gelatin to silver halide (expressed as silver nitrate) ratio from 2:10 to 6:10 and has an amount of silver halide corresponding to from 5 g to 15 g of silver per $m^2$ and wherein said photographic material has been fore-hardened to such an extent that when it is immersed in demineralized water of 25° C. for 3 minutes there is absorbed less than 2.5 g of water per gram of gelatin, characterized in that said silver chloride or silver chlorobromide emulsion crystals are chemically ripened in the presence of at least one sulphur compound and at least one gold compound, wherein gold is present in an amount from 0.01 to 1 μmole per mole of silver halide, the molar ratio of sulphur to gold being less than 1.0.

14 Claims, 1 Drawing Sheet

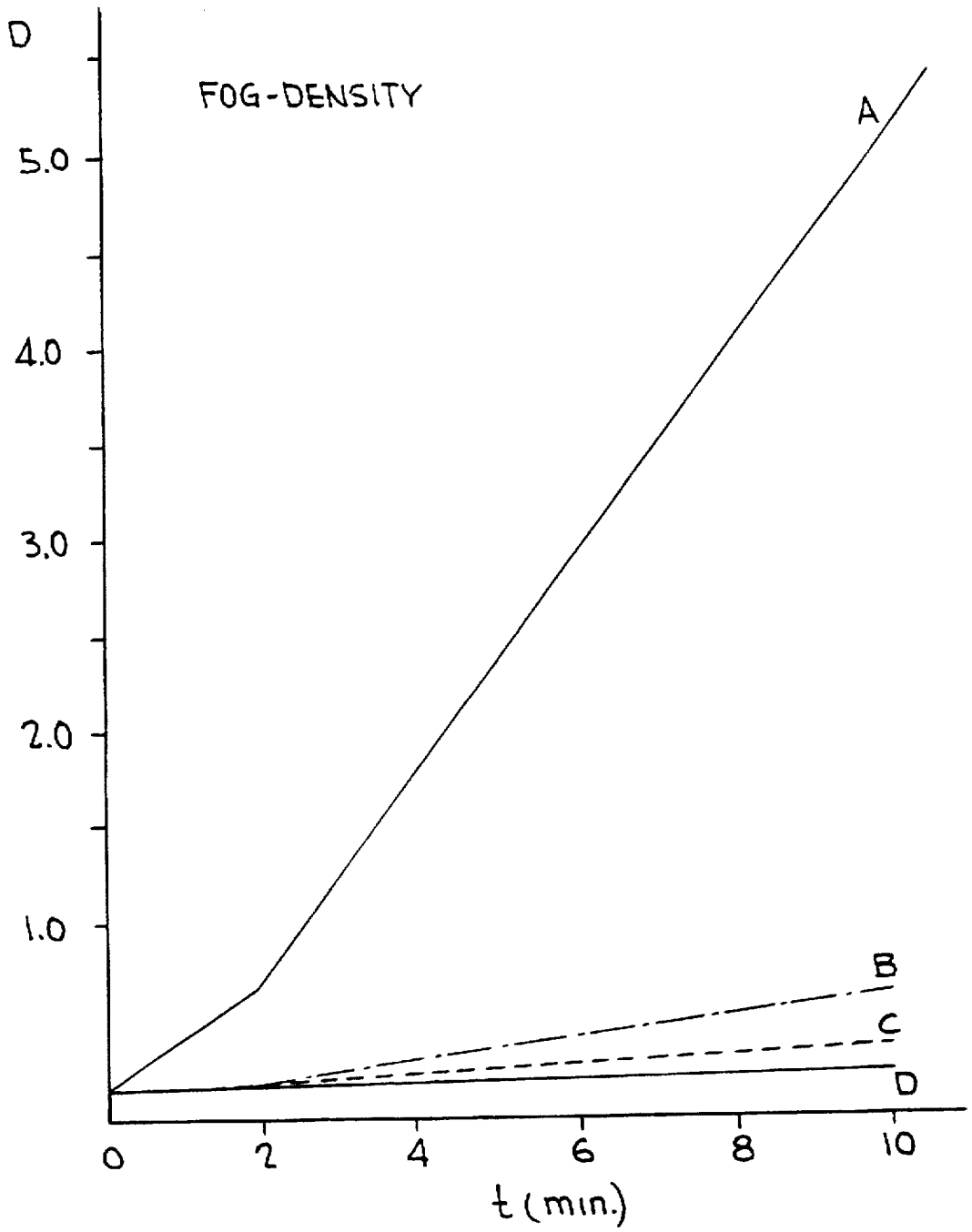
D
FOG-DENSITY
5.0
4.0
3.0
2.0
1.0
A
B
C
D
0
2
4
6
8
10
t (min.)

X-RAY SILVER HALIDE PHOTOGRAPHIC MATERIAL SUITABLE FOR MAINTENANCE IN BRIGHT DARKROOM LIGHTING CONDITIONS

FIELD OF THE INVENTION

The present invention relates to photographic materials for industrial radiography having silver halide emulsion grains rich in chloride and capable of being maintained in bright darkroom lighting conditions.

BACKGROUND OF THE INVENTION

In the field of industrial radiography, especially for non-destructive testing applications, not only any time saving measure is welcome but any handsome way of processing the testing film is highly appreciated.

After exposure with direct-röntgen rays, industrial non-destructive testing film has traditionally been automatically processed in a cycle, varying from 8 to 12 minutes. A significant reduction of the processing time to a maximum of 5 minutes has been proposed in EP-A 538 947.

In the said EP-A a silver halide photographic material for industrial radiography has been disclosed which has a satisfactory photographic performance even in rapid processing, i.e. higher development and fixing efficiency; an increased efficiency and capacity in the processing of industrial silver halide photographic material while maintaining an excellent image quality, especially image sharpness, and good physical properties. Moreover the said photographic material offers the advantage of more ecological processing conditions in that less chemicals are consumed in both developing solution and fixer requiring less regeneration and in that the processing solutions are free from hardening agents thus offering the possiblity of using the more customer-friendly one-part packaging, optionally with a fixer free from ammonium ions.

As is well-known a weak point in the maintenance of the film after exposure to direct-röntgen radiation is its treatment in dark-room light of low intensity before starting the processing cycle.

For someone skilled in the art of photography a well-known way to make X-ray materials suitable for use in roomlight is the incorporation in silver halide materials of desensitizers as has been described e.g. in U.S. Pat. No. 3,922,545 and in Research Disclosures No. 11732, published Jan. 1974 and No. 12124, published May 1974.

Already in 1932, in GB-Patent 543 993, nitro-substituted cyanine compounds are described as desensitizers. Later on roomlight hand-lable photographic X-ray-sensitive materials comprising silver halide desensitizing compounds and/or one or more dyes have been described in U.S. Pat. Nos. 3,237,008; 3,184,313; 3,314,790; 3,630,744; 3,658,547; 3,970,461; 3,832,184; in FR-P's 700 529; 1 276 168, in DE 2 149 217 and in EP-S 88 581.

More recently in EP-A 518 323 the use in radiographic materials of reduction sensitized silver halide crystals, combined with the addition of metal salts, especially the salts of iron, copper and zinc, has been described.

Silver halide photographic films for use in graphic arts comprising silver halide emulsions having a low sensitivity for ultraviolet radiation are further well-known. Very characteristic in those films is the incorporation of very small crystals rich in chloride having an average diameter of less than 0.2 μm, doped with about 100 ppm of rhodium ions, further comprising filter dyes and desensitizers. Silver halide crystals are coated therein in an amount of about 5 g/m$^2$, expressed as the equivalent amount of $AgNO_3$. A frequently used desensitizer therein is pinakryptol yellow, which is present in an amount of about 250 mg per mole of silver halide coated.

OBJECTS OF THE INVENTION

Therefor a first object of the present invention is to provide a silver halide photographic material for industrial radiography offering the advantage of maintenance of the said material before processing in quasi roomlight conditions i.a. conditions wherein it is still possible to read any written information without complications.

A second object of this invention is to provide the said advantage without additional costs for the customer and without loss in speed, image quality or rapid processing applicability.

Other objects will become apparent from the description hereinafter.

SUMMARY OF THE INVENTION

The above objects are accomplished by a silver halide photographic material for industrial radiography comprising a film support and on one or both sides thereof at least one gelatino silver halide emulsion layer wherein each silver halide emulsion layer comprises as silver halide emulsion crystals silver chloride and/or silver chlorobromide emulsion crystals the amount of bromide therein being at most 25 mole %; has a gelatin to silver halide (expressed as silver nitrate) ratio from 2:10 to 6:10 and has an amount of silver halide corresponding to from 5 g to 15 g of silver per m$^2$ and wherein said photographic material has been fore-hardened to such an extent that when it is immersed in demineralized water of 25° C. for 3 minutes there is absorbed less than 2.5 g of water per gram of gelatin, characterized in that said silver chloride or silver chlorobromide emulsion crystals are chemically ripened in the presence of at least one sulphur compound and at least one gold compound, wherein gold is present in an amount from 0.01 to 1 μmole per mole of silver halide, the molar ratio of sulphur to gold being less than 1.0.

The present invention also provides the optional use in the said material of a spectral desensitizer and/or a filter dye.

DETAILED DESCRIPTION OF THE PRESENT INVENTION

Conventional photographic silver halide films used in industrial radiography are very sensitive to visible light. To illustrate this a comparison as a function of time (in minutes) is given in Table 1 between fog-values obtained for the high-sensitive STRUCTURIX D7p and the medium-sensitive STRUCTURIX D4p reference films, both films being trademark names from Agfa-Gevaert) after weak exposure with radiation having a wavelength of 589 nm from a sodium vapour source having a luminance of about 2 Lux, followed by processing those films for 2 minutes at 28° C. in G135 developer (trademarked name from Agfa-Gevaert).

TABLE 1

| Material | 0 | 5 | 10 | 20 | 30 |
|---|---|---|---|---|---|
| STRUCTURIX D7p | 0.20 | 0.35 | 0.57 | 0.97 | 1.15 |
| STRUCTURIX D4p | 0.17 | 0.21 | 0.26 | 0.42 | 0.53 |

Both films are coated from silver bromoiodide crystals having 1 mole % of iodide and from amounts of silver, expressed as the equivalent amount of silver nitrate of 29 and 21 g/m$^2$ respectively.

Replacement of those silver bromoiodide emulsions by silver chloride emulsions having about the same average crystal diameter leads to a lower increase in fog. The said silver chloride crystals together with silver halide crystals rich in chloride having at least 75 mole % of chloride and less than 25 mole % of bromide and the corresponding materials comprising the said crystals have been fully described in EP-A 0 538 947, which is incorporated herein by reference.

Addition to the said materials comprising silver halide crystals rich in chloride of a conventional desensitizer as e.g. pinakryptol yellow, makes fog stay at a constant level as a function of time, which corresponds with the state-of-the-art described hereinbefore.

In practical circumstances, in order to provide comfortable handling conditions for the customer, the said industrial radiographic film material should be resistant to radiation with a luminance of about 25 Lux coming from a fluorescent tube coated with a filter layer absorbing light having a wavelength higher than 450 nm, present in the "darkroom" as lighting source.

It has unexpectedly been found that the required high speed for X-ray exposure as well as a sufficient low fog due to "darkroom exposure" of the same material could be attained by strongly decreasing the amount of gold ions used in the chemical ripening in the presence of at least one labile sulphur compound to a level from 0.01 to 1 μmole per mole of silver, maintaining the molar ratio of sulphur to gold ions to a value of less than 1.0. Chemical sensitizers have been described e.g. in EP-A 0 538 947, and in the descriptions in Research Disclosures 17643, 18716, 30819 and 36544 respectively, which can be applied to this subject.

In accordance with the present invention the emulsions used in the material according to this invention are containing silver chloride crystals and/or silver chlorobromide crystals containing up to 25 mol % bromide-ions, with a more preferred bromide-ion concentration in the crystals of up to 5 mole %.

For the preparation of gelatino silver chloride or chlorobromide emulsions used in the materials in accordance with the present invention we refer to EP-A 0 538 947, and to the descriptions in Research Disclosures 17643, 18716, 30819 and 36544 as given hereinbefore.

Although a homogeneous distribution of the silver halide used over the whole volume of the silver halide crystals, for which the composition of the halide solution remains unchanged during the whole precipitation is preferred, the said distribution can be inhomogeneous as e.g. in a core-shell or multistructure emulsion. The composition of the halide solutions is varied therein during the growth stage.

When using conventional precipitation conditions silver halide emulsion grains rich in chloride show a cubic morphology with (100) crystal faces offering better developing characteristics than other crystallographic forms, as e.g. octahedral, rhombic dodecahedral or tabular silver chloride crystals, which require the use of so-called "growth modifiers" or "crystal habit modifiers". However, chloride emulsions having crystallographic form other than cubic can be used. The silver halide grains used in accordance with the present invention preferably have an average grain size from 0.15 to 1.2 μm, more preferably up to 1.0 μm and still more preferably up to 0.8 μm.

In a preferred embodiment the size distribution of the silver halide crystals is homogeneous.

Although it can be shown that the objects of this invention are attained by the measures taken as described hereinbefore, it is preferred that in addition a small amount of one or more desensitizing agent(s) is(are) present in the emulsion layer(s) of the material according to this invention. A preferred amount is less than 15 μmoles of said desensitizing agent(s), more preferably less than 10 μmoles and still more preferably less than 5 μmoles per mole of silver halide coated. Moreover at least one filter dye in at least one layer overcoating the said emulsion layer(s) is optionally used.

Preferred desensitizing agents are the agents corresponding to the following formula(e)

C-1

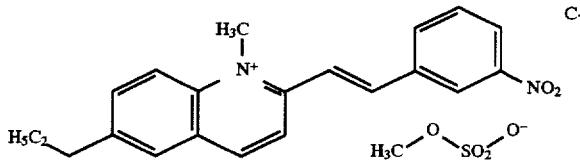

C-2

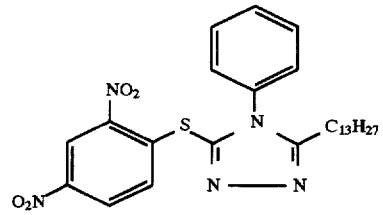

C-3

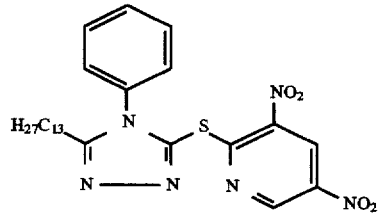

C-4

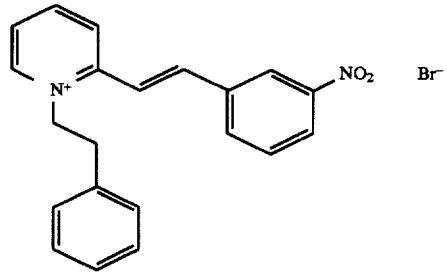

Preferred filter dyes are those having 50 % of their maximum absorption density above a wavelength value of 450 nm. Specific dyes useful for that purpose correspond to the general formula(e) described in GB 964 773; U.S. Pat. Nos. 3,984,246; 5,344,749; 5,380,634; EP-A's 0 586 748, 0 586 749 and 0 656 401; and EP-A No 94203766, filed Dec. 27, 1994.

Amounts of dyes coated in one or more layers overcoating the emulsion layer(s) are preferably from about 0.05 to about 0.20 mmole/m$^2$.

The photographic material according to this invention preferably is a duplitized radiographic material having a silver halide emulsion layer on both sides of the support.

The ratio of gelatin to silver halide (expressed as the equivalent amount of silver nitrate) in the silver halide emulsion layers of the photographic material according to the present invention is from 0.2 and 0.6, and more preferably from 0.3 to 0.5.

The gelatin binder of the photographic elements according to the present invention can be hardened with appropriate hardening agents such as those described in EP-A 0 538 947, and in the descriptions in Research Disclosures 17643, 18716, 30819 and 36544 respectively, which can be applied to this subject.

According to this invention hardening is to such an extent that when the photographic material is immersed in demineralized water of 25° C. at most 2.5 g of water is absorbed per gram of gelatin in 3 minutes.

Further antifoggants, development accelerators, surfactants, antistatic agents, plasticizers, slipping agents, matting agents can be present as described in EP 538 947, and in the descriptions in Research Disclosures 17643, 18716, 30819 and 36544 respectively, which can be applied to these topics.

As the photographic material according to the present invention preferably is a duplitized material, having thereby emulsion layers on both sides of the film support, both emulsion layers are overcoated with an antistress top layer.

The support of the photographic material in accordance with the present invention may be a transparent resin, preferably a blue coloured polyester support like polyethylene terephtalate or polyethylene naphthalate. The thickness of such organic resin film is preferably about 175 μm. The support is provided with a substrate layer at both sides to have good adhesion properties between the emulsion layer and the said support.

The photographic material can be image-wise exposed by means of an X-ray radiation source the energy of which, expressed in kV, depends on the specific application. Another typical radiation source is a radioactive $Co^{60}$ source. To reduce the effect of scattering radiation a metal filter, usually a lead filter, is used in combination with the photographic film.

For processing, preferably an automatically operating apparatus is used provided with a system for automatic replenishment of the processing solutions. Film materials in accordance with this invention may be processed in developer solutions of different compositions as e.g. hydroquinone-1-phenyl-3-pyrazolidinone, 1-phenyl-3-pyrazolidinone-ascorbic acid and ascorbic acid or its derivatives. An amount of potassium thiocyanate in the range of 0.1 to 10 g pro liter of the developer solution is recommended to obtain high gradation values. An amount of 25 to 250 mg of potassium iodide pro liter is particularly recommended to obtain a higher speed. Especially preferred are the developers described in EP-A Nos 95200417-19, filed Feb. 21, 1995, but especially those described in EP-A No. 95200419 are preferred, said EP-A which is incorporated herein by reference.

The developer solution according to the invention should be replenished not only for decrease of the liquid volume due to cross-over into the next processing solution but also for pH-changes due to oxidation of the developer molecules. This can be done on a regular time interval basis or on the basis of the amount of processed film or on a combination of both.

The development step is followed by a washing step, a fixing step and, optionally, another washing or stabilization step.

According to the processing method of this invention the steps of developing, fixing, washing and drying are performed in a total processing time from 2 minutes to less than 5 minutes.

For film materials comprising silver chloride or silver chlorobromide emulsions in accordance with the present invention it is possible to use sodium thiosulphate as a fixing agent, thus avoiding the ecologically undesired ammonium ions normally used.

According to the method of this invention the developer and/or the fixer is(are) substantially free from hardening agents.

Finally after the last washing step the photographic material is dried. The following examples illustrate the invention without however being limiting thereto.

6. EXAMPLES.

Example 1.

The preparation of the industrial radiographic materials comprising silver halide crystals rich in chloride was as follows:

A silver chloride emulsion was prepared by a double jet technique. The silver halide composition was 98 mole % of chloride and 2 mole % of bromide and the average grain size was 0.40 μm using methionin as a growth accelerator in an amount of 12 g pro 2.1 l starting volume in the vessel, containing 90 g of inert gelatin and 40 mmoles of sodium chloride at 60° C. Concentrated solutions of 1 l of $AgNO_3$ and NaCl/KBr 98/2, 2.94 N each, were run with the double jet technique in the vessel in a total time of 3 minutes for the $AgNO_3$ solution and in 2 minutes and 45 seconds for the mixed halide solution. After physical ripening during 12 minutes at 60° C., 100 ml of a solution of KI (1% by weight) was added. 5 minutes later toluene thiosulphonic acid was added in an amount of 3.5 mg, followed by the addition of gold in an amount of 7.3 μmole one minute later. After a digestion time of 20 minutes another 90 ml of a solution of KI (1% by weight) was added, followed after 5 minutes by 1-phenyl-5-mercaptotetrazole, which was added as a stabilizer in an amount 150 mg.

After this ripening step, performed in the reaction vessel, without the presence of thiosulphate ions, the flocculation procedure could begin: pH was adjusted at a value of 3.3 with sulphuric acid, 3M, and 10 g of polystyrene sulphonic acid was added slowly in 2 minutes. The washing procedure was performed in a discontinous way, adding 3.5 l of demineralized water. After sedimentation of the flocculate and decantation this washing procedure was still repeated three times. After addition of inert gelatin to a ratio of gelatin to silver nitrate in the emulsion of about 0.5, the emulsion was peptized and phenol was added as a biocide.

The emulsions were coated at both sides of a substrated blue polyester of 175 μm thickness by means of the slide hopper technique, the emulsion layers each containing silver halide emulsion crystals, expressed as $AgNO_3$, in an amount of 10.5 g/m$^2$ and in an amount of 5.25 g/m$^2$ gelatin. Both emulsion layers were covered with a protective layer coated at 1.40 g/m$^2$ of gelatin and hardened with formaldehyde and resorcinol to such an extent that when immersed in demineralized water of 25° C. for 3 minutes about 2 g of water was absorbed.

In practical circumstances, in order to provide comfortable handling conditions for the customer, the said industrial radiographic film material should be resistant to radiation with a luminance of about 25 Lux irradiated from a light source coated with a filter layer absorbing light having a wavelength higher than 450 nm, hanging in the "darkroom".

The sole FIGURE shows that under these exposure conditions even the presence in the said film material of silver halide crystals rich in chloride and a desensitizing agent is insufficient to suppress the formation of fog due to a "darkroom lighting" as described hereinbefore (see curve "A"). A decrease of the amount of $Ag_2S$ formed during the chemical ripening step by reduction of the amount of labile sulphur thereby adding less sodium thiosulphate, leads to an insufficient decrease of fog as a function of time in these lighting conditions: even a complete elimination of labile sulphur, thus only ripening with gold ions, doesn't give rise to the desired constant low fog level (see curve "B"). The only sufficient measure leading to the required insensitivity to "darkroom lighting conditions" as described above, is the reduction of the amount of gold ions used in the chemical ripening step with a factor of at least 5 (see curve "C" and more preferably with a factor of at least 10 (see curve "D"), which corresponds with an amount of not more than about 1 μmole per mole of silver coated as is clearly illustrated in the sole FIGURE.

Sensitometric results obtained for the corresponding industrial radiographic materials coated from the emulsions, chemically ripened in the presence of different amounts of thiosulphate and/or gold are given in Table 2. Exposure and processing conditions are given hereinafter.

Exposure conditions

The coated and dried films were exposed with with a 235 kV radiation source placed at a distance of 1.50 m in contact with a copper filter of 8 mm thickness. Before exposure to X-rays all materials were treated completely in the dark before processing in order to eliminate "darkroom lighting".

Processing of the comparative Structurix D4p film (trademarked product from Agfa-Gevaert) proceeded for 2 minutes at 28° C. in G135 developer (trademarked name from Agfa-Gevaert), followed by fixing solution in G335 (trademarked name from Agfa-Gevaert) and rinsing. All other films were processed in the following processing solutions:

| Developer solution: | |
|---|---|
| hydroquinone | 20 g |
| 1-phenyl-3-pyrazolidinone | 0.8 g |
| potassium bromide | 10 g |
| potassium iodide | 0.1 g |
| phenylmercaptotetrazole | 0.03 g |
| potassium thiocyanate | 2.5 g |
| polyglycol (M.W. 400) | 10 ml |
| aqueous potassium sulphite (655 g/l) | 150 ml |
| aqueous potassium carbonate (765 g/l) | 40 ml |
| agueous potassium hydroxyde (755 g/l) | 10.4 ml |
| Trilon B (trade name for $Na_4EDTA$ from BASF) | 4 ml |
| Turpinal 2NZ (trade name for 1-hydroxy-ethyldiphosphonic acid disodium salt from HENKEL) | 1 g |
| pH 10.85 | |
| Water to make 1 liter. | |
| Fixing solution | |
| Sodium thiosulphate | 200 g |
| Potassium metabisulphite | 25 g |
| pH = 4.9 to 5.2 | |
| Water to make 1 liter. | |

Sensitometric results listed in Table 2 are the fog value "F" (expressed as a density), speed value "S" expressed in log K at a density of 2.0 (a lower value of log K indicating a higher film speed) and the average gradient G between a density D=1.5 and 3.5.

Amounts of sulphur and gold are expressed in μmole/mole of silver.

TABLE 2

| Material | $[Au^+]$ | $[S^{2-}]/[Au^+]$ | F | S | G |
|---|---|---|---|---|---|
| 1 | 8 | 10 | 0.16 | 2.01 | 5.26 |
| 2 | 16 | <1 | 0.14 | 2.08 | 5.55 |
| 3 | 8 | <1 | 0.14 | 2.03 | 5.43 |
| 4 | 1.6 | <1 | 0.14 | 1.97 | 5.40 |
| 5 | 0.8 | <1 | 0.15 | 1.98 | 6.01 |
| D4p (comp) | 27 | 3.3 | 0.18 | 1.96 | 5.28 |

As can be seen from Table 2 the influence of amounts of chemical ripening agents and ratios between them after exposure to direct X-rays and processing in the conventional processing cycle is remarkably small.

Table 3 gives differences in fog level δF measured after processing the materials for different processing times. The said materials were not exposed to direct X-rays, but to "darkroom light" having a luminance of 25 Lux from a light source coated with a filter L453 absorbing light having a wavelength higher than 453 nm.

TABLE 3

| Mat. | $[Au^+]$ | $[S^{2-}]/[Au^+]$ | δF (30 s) | δF (60 s) | δF (120 s) | δF (300 s) | δF (600 s) |
|---|---|---|---|---|---|---|---|
| 1 | 8 | 10 | 0.09 | 0.25 | 0.53 | 2.12 | 4.92 |
| 2 | 16 | <1 | 0.00 | 0.00 | 0.02 | 0.12 | 0.25 |
| 3 | 8 | <1 | 0.00 | 0.00 | 0.02 | 0.17 | 0.48 |
| 4 | 1.6 | <1 | 0.00 | 0.00 | 0.02 | 0.11 | 0.20 |
| 5 | 0.8 | <1 | 0.00 | 0.02 | 0.03 | 0.04 | 0.08 |
| D4p | 27 | 3.3 | >4.0 | | | | 0.09 |

As can be seen from Table 3 after longer periods of time (5 to 10 minutes and longer) the increase in fog is more reduced the lower the amounts of gold in the chemical ripening are, provided that the ratio of sulphur to gold is lower than 1. Opposite thereto D4p becomes fully fogged after a few seconds.

The use of a chemically unripened or so-called "primitive emulsion" is however excluded in the context of this invention as in that case the material is completely unsensitive: no density is built up after X-ray irradiation, followed by processing.

Example 2

Materials Nos. 6–8 were prepared from the same emulsion as in Example 1.

Material No. 6 was coated from the normal additives used, without any other ingredient.

To the emulsion layers of Material No. 7, pinakryptol yellow was added in an amount of 1.8 μmole per mole of silver coated.

To the protective antistress layers of Material No. 8, filter dyes according to the formulae D-1 and D-2, given hereinafter, were added in an amount of 0.18 and 0.14 mmole/$m^2$ respectively.

Emulsion layers of Material No. 8 didn't contain any desensitizing agent.

D-1

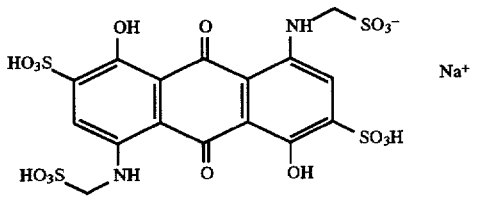

D-2

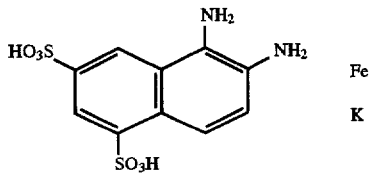

Exposure and processing conditions were corresponding to those described for the Materials Nos. 1–5. Fog increase however was tested in other "darkroom lighting" conditions. Therefor "bright yellow light" was used as a fluorescent tube was covered with another filter: CL52, filtering any radiation having a wavelength higher than 520 nm. The total luminance was set at 100 Lux, and the material was exposed to this light source for 60 minutes. Sensitometric results (fog, speed, gradation) and fog increase in darkroom lighting are summarized in Table 4 for Materials Nos. 1 (see Example 1), 6–8 and STRUCTURIX D4p (comparative).

TABLE 4

| Material No. | F | S | G | δF (3600 s) |
|---|---|---|---|---|
| 1 (see Tables 2 & 3) | 0.16 | 2.01 | 5.26 | 1.30 |
| 6 (inv.; chem. ripened) | 0.13 | 1.94 | 5.38 | 0.07 |
| 7 (inv.; desensib.) | 0.13 | 1.98 | 5.25 | 0.00 |
| 8 (inv.; filter dye) | 0.13 | 1.93 | 5.53 | 0.00 |
| STRUCTURIX D4p | 0.18 | 1.96 | 5.28 | 0.93 |

As can be seen from Table 4 after an exposure time of 1 hour the materials Nos. 6–8, according to this invention are still remarkably insensitive to darkroom light, whereas their sensitivity is sufficiently high. The addition to the emulsion layers of a desensitizing dye in low concentrations (less than 15 μmole per mole of silver coated) or to the protective antistress layers of suitable filter dyes has a further favourable effect on fog increase in darkroom light for a long period of time.

In all cases the materials having silver halide crystals rich in chloride, ripened under the proposed conditions, according to this invention, provide a very good maintenance under bright darkroom lighting conditions, opposite to the comparatives or reference materials.

We claim:

1. A silver halide photographic material for industrial radiography comprising a film support and on one or both sides thereof at least one gelatino silver halide emulsion layer wherein each silver halide emulsion layer comprises silver chloride and/or silver chlorobromide grains having an amount of bromide at most 25 mole %; a gelatin to silver halide (expressed as silver nitrate) ratio from 2:10 to 6:10 and an amount of silver halide corresponding to from 5 g to 15 g of silver per $m^2$ and wherein said photographic material has been fore-hardened to such an extent that when immersed in demineralized water at 25° C. for 3 minutes an amount of less than 2.5 g of water per gram of gelatin is absorbed and wherein, said silver chloride or silver chlorobromide grains have been chemically ripened in the presence of at least one sulphur compound and at least one gold compound, wherein gold is present in an amount from 0.01 to 1 μmole per mole of silver halide and wherein a molar ratio of sulphur to gold is less than 1.0.

2. A photographic silver halide material according to claim 1, wherein silver chlorobromide grains are present with amounts of bromide being at most 5 mole %.

3. A photographic material according to claim 1, wherein the size distribution of the silver halide grains and/or the halide distribution over the volume of the said silver halide grains is homogeneous.

4. A photographic material according to claim 1, wherein at least one desensitizing agent is present in the emulsion layer(s) in an amount of less than 15 μmole per mole of silver coated and/or wherein at least one filter dye is present in at least one layer overcoating the said emulsion layer(s).

5. A photographic material according to claim 4, wherein at least one desensitizing agent is present in the emulsion layer(s) in an amount of less than 10 μmole per mole of silver coated and/or wherein at least one filter dye is present in at least one layer overcoating the said emulsion layer(s).

6. A photographic material according to claim 4, wherein at least one desensitizing agent is present in one or more emulsion layer(s) in an amount of less than 5 μmole per mole of silver coated and/or wherein at least one filter dye is present in at least one layer overcoating the said emulsion layer(s).

7. A photographic material according to claim 4, wherein said desensitizing agent is selected from the group consisting of compounds C-1 , C-2 , C-3 and C-4 shown below

C-1

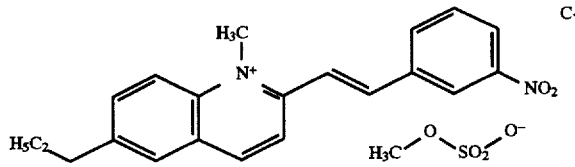

C-2

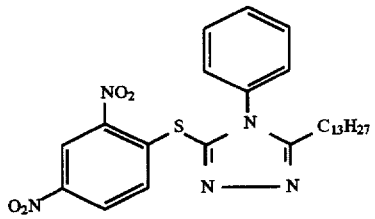

C-3

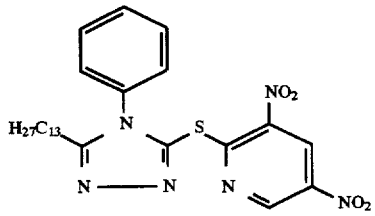

C-4

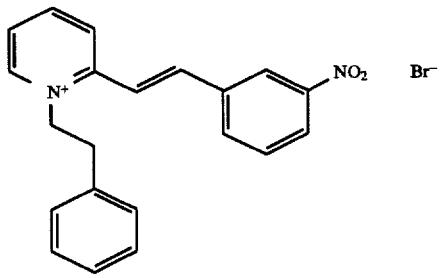

8. A photographic material according to claim 4, wherein said filter dye is a filter dye having 50% of its maximum absorption density above a wavelenght of 450 nm.

9. A photographic material according to claim 1, wherein said material is a duplitized radiographic material having a silver halide emulsion layer on both sides of the support.

10. Method of processing a radiographically exposed photographic material for industrial radiography according to claim 1, comprising the steps of developing, fixing, washing and drying wherein the total processing time is from 2 minutes to less than 5 minutes.

11. Method according to claim 10, wherein developer and/or fixer is(are) substantially free from hardening agents.

12. Method according to claim 10, wherein the fixer is substantially free from ammonium ions.

13. Method according to claim 10, wherein said developer contains hydroquinone and a 1-phenyl-3-pyrazolidinone developing agent.

14. Method according to any of claims 10 to 12, wherein said developer contains ascorbic acid and/or 4-hydroxymethyl-4-methyl-1-phenyl-3-pyrazolidinone.

* * * * *